US008651492B1

(12) United States Patent
Cappuccio

(10) Patent No.: US 8,651,492 B1
(45) Date of Patent: Feb. 18, 2014

(54) DRINKING GAME

(76) Inventor: Paul Cappuccio, Hammonton, NJ (US)

( * ) Notice: Subject to any disclaimer, the term of this patent is extended or adjusted under 35 U.S.C. 154(b) by 350 days.

(21) Appl. No.: 13/199,296

(22) Filed: Aug. 25, 2011

Related U.S. Application Data

(60) Provisional application No. 61/402,467, filed on Aug. 30, 2010.

(51) Int. Cl.
*A63B 67/00* (2006.01)
*A63B 63/08* (2006.01)
*A63F 7/00* (2006.01)

(52) U.S. Cl.
USPC ..... 273/348; 273/317; 273/317.3; 273/398; 273/402

(58) Field of Classification Search
USPC ..... 273/317, 317.3, 348, 398, 400, 401, 273/402
See application file for complete search history.

(56) References Cited

U.S. PATENT DOCUMENTS

| | | | | | |
|---|---|---|---|---|---|
| 2,893,734 | A | * | 7/1959 | Tarte, Jr. | 273/317.3 |
| D222,978 | S | * | 2/1972 | Vinas | D21/705 |
| 3,703,291 | A | | 11/1972 | Lutz | |
| 3,724,855 | A | | 4/1973 | Chu | |
| 3,958,806 | A | * | 5/1976 | Brown | 273/317.3 |
| 4,013,292 | A | * | 3/1977 | Cohen et al. | 273/371 |
| 4,210,328 | A | | 7/1980 | Meintzer et al. | |
| 4,326,722 | A | * | 4/1982 | Dickens | 273/400 |
| 4,496,160 | A | * | 1/1985 | Wichinsky et al. | 273/369 |
| 4,973,056 | A | | 11/1990 | Nutting | |
| 5,125,651 | A | * | 6/1992 | Keeling et al. | 473/448 |
| 5,150,898 | A | | 9/1992 | Hochberg et al. | |
| 5,516,114 | A | * | 5/1996 | Michlin et al. | 273/400 |
| 5,842,699 | A | * | 12/1998 | Mirando et al. | 273/317.3 |
| D405,123 | S | * | 2/1999 | Dekeyser et al. | D21/303 |
| 7,325,807 | B1 | * | 2/2008 | Eason | 273/342 |
| 7,523,942 | B2 | * | 4/2009 | Chung | 273/317.1 |
| 8,028,995 | B2 | * | 10/2011 | Hoffer | 273/342 |
| D656,199 | S | * | 3/2012 | Kaylor et al. | D21/300 |
| 8,146,921 | B2 | * | 4/2012 | Lombardi | 273/342 |
| 8,205,887 | B2 | * | 6/2012 | Wyland | 273/342 |
| 2004/0188942 | A1 | | 9/2004 | Trokan | |
| 2005/0029747 | A1 | | 2/2005 | Grayson | |
| 2006/0226606 | A1 | * | 10/2006 | Finley et al. | 273/342 |
| 2008/0252018 | A1 | * | 10/2008 | Chung | 273/402 |
| 2009/0051133 | A1 | * | 2/2009 | Oshiro | 280/47.18 |
| 2010/0140873 | A1 | * | 6/2010 | Britton et al. | 273/398 |
| 2010/0148434 | A1 | * | 6/2010 | Brustmeyer | 273/108 |
| 2011/0089640 | A1 | * | 4/2011 | Pecherski | 273/400 |
| 2012/0169012 | A1 | * | 7/2012 | Parker et al. | 273/400 |

* cited by examiner

*Primary Examiner* — Raleigh W Chiu
(74) *Attorney, Agent, or Firm* — Norman E. Lehrer

(57) ABSTRACT

An apparatus for playing a drinking game includes a base support member and a vertical pole extending upwardly from the base support member. A vertically extending backboard is secured to the pole adjacent the top thereof and a plurality of hoops are removably secured to the backboard. Plastic drinking cups are held in each of the hoops. The apparatus further includes a plurality of ping pong balls capable of being tossed into and maintained in the cups. The entire apparatus can be disassembled so that it is portable. That is, the hoops are removably secured to the backboard which is removably secured to the vertical pole. In addition, the vertical pole is comprised of several pole sections that fit together in a telescoping manner. The base includes a carrying handle and functions as a carrying case for holding and transporting the pole sections and the hoops with the backboard serving as a cover for the case.

8 Claims, 5 Drawing Sheets

DRINKING GAME

CROSS-REFERENCE TO RELATED APPLICATION

The present application claims the benefit of prior U.S. Provisional Application Ser. No. 61/402,467, filed Aug. 30, 2010.

BACKGROUND OF THE INVENTION

The present invention relates generally to a drinking game similar to beer pong and more particularly, toward a drinking game that incorporates some of the elements of beer pong with elements of the game of basketball.

The traditional game of "Beer Pong" (also known as "Beirut") is an immensely popular beer drinking game played throughout the United States. It is regularly played on university and college campuses, at beach house parties and other festive occasions at which alcoholic beverages, such as beer, are present. Such festive occasions are typically attended by students in their twenties. The rules and playing styles of beer pong are fairly consistent throughout the country. Generally, two or four individuals participate at one time. These individuals are typically divided into two opposing teams. Each team arranges ten to twenty cups in the shape of a pyramid near the end of a table.

The arrangement of cups at the beginning of the game should resemble the initial rack of pool balls in a game of "eight-ball." Each team thereafter fills each cup with a preselected amount of beer. Filling is continued until each cup is about one-quarter to about one-half full. The players then take turns tossing or bouncing ping pong balls across the length of a table. An object of the game is to cause a beer pong ball to land in an opponent's cup. If a player's opponent succeeds in "making a shot," that player must drink the cup into which the beer pong ball landed. The empty cup is then removed from the table. A team that successfully eliminates each of the opponent's cups first is the victor. When this occurs, the losing team must "down" the entire contents of the winning team's remaining filled cups.

Attempts have been made to standardize the set-up of the cups into which the ping pong ball is tossed. U.S. Patent Application No. 2005/0029747, filed by Finley et al., discloses a triangular holder, similar to a pool ball rack, for aligning the target cups at each end of the table. The holder includes ten circular cut-outs arranged in a triangular formation similar to a bowling-pin or billiard-ball arrangement. The holder is placed on a table and a cup is inserted into each cut-out.

U.S. Pat. No. 7,325,807 to Eason improves upon the Finley et al. device by incorporating the cup-holding surface into the table such that all of the cup holders are integral parts of the table and cannot get lost, misplaced or broken. Furthermore, U.S. Patent Application No. 2004/01888942 to Troken elaborates on the same theme by providing standardized ping pong balls that may contain one or more "messages" or instructions to the players upon making a successful beer pong shot (e.g., EXCHANGE an article of clothing; reveal a SECRET; reveal a FANTASY; REMOVE an article of clothing, etc.).

The Internet Publication entitled "Beer Pong Rules" at http://www.gotponq.com/beerponq/rules/ discloses rules for a conventional beer pong game. A plurality of cups containing one or more alcoholic beverages is arranged in 3-2-1 pyramidal fashion. Two players toss ping pong balls, attempting to direct the balls into one of the cups. Ping pong balls may be tossed directly or bounced on a substrate. If a ball touches a cup, it is considered "sunk," whereupon the cup contents must be consumed by the opposing team. "Scaling" occurs when a ball is tossed with the intention of knocking over a cup. In the event of scaling, the team whose player threw the ball is penalized by one cup. If, during game play, one team retains four cups while the other team's cup count reaches two, the losing team is "skunked" and must consume all six of the cups. The "Beer Pong Rules" publication discloses conventional rules for a beer pong game. As described therein, a conventional beer pong game requires the use of alcoholic beverages.

The Internet Publication entitled "Rules Without Paddles—National Beer Pong League" at http://www.nbpl.net/rulesno.html discloses 14 variations of the conventional beer pong game. The "Rules Without Paddles" publication describes variations of the beer pong game conventionally played throughout the United States at different localities. Each of the variations requires use of alcoholic beverages.

The Internet Publication "Neave's Beer," as described by the BP website located at http://www.neave.com/beer/your-games/beirut.html, discloses a conventional beer pong game variant wherein a coin is tossed into a plurality of beer cups instead of a ping pong ball. Each of the beer cups into which the coin is tossed contains beer or a similar alcoholic beverage.

The Internet Publication "Beirut Instructor," as described by a website located at http://h0020e0642dd9.ne.client2.attbi.com/, describes yet another variation of the beer pong game. Two sets, each containing six twelve-ounce cups, are arranged in a rack to form a pyramid. Two twelve-ounce beers are dispersed among the cups in each rack. Each team has two players, one of which is assigned to a rack. Teams take turns throwing a ping pong ball into the opposing team's cups. If a ball lands in a cup, it is removed from the rack. The first team to knock out all of the opposing team's cups is the winner. An alcoholic beverage, preferably beer, is required, together with ping pong balls, which are tossed by the players to eliminate cups belonging to the opposing team.

The Internet Publication entitled "Column: Playing The Name Game With A Party Classic," located at http://www.nbpl.net/dailyorange.html, addresses an issue frequently discussed on college campuses, namely, whether the correct title for the most popular drinking game is "Beirut" or "Beer Pong." The Daily Orange publication attempts to define the difference between beer pong and Beirut. It concludes that beer pong refers to any variation of the game that uses paddles to hit the ball in the cup, while in Beirut the ball is thrown by hand. This distinction is based on a quote from Jason Keith, head of the National Beer Pong League. According to Jason Keith, "The difference between Beer Pong and Beirut is that Beer Pong refers to any variation of the game that uses paddles to hit the ball into a cup, while in Beirut, the ball is thrown by hand." Significantly, each of the Beirut and beer pong games defined by the "Name Game" publication requires use of alcoholic beverages.

The Internet Publication entitled "BP—the game—Our Rules" located at http://home.earthlink.net/2BP/pages/bprules.html discloses rules for a conventional beer pong game. A plurality of cups (typically three) containing one or more alcoholic beverages are arranged on a regulation 9×5 foot ping pong table on opposing sides of a 6-inch high ping pong net. A center cup is placed directly on the centerline of the table, two paddle lengths from the end line. The two outside cups are placed on either sideline in similar fashion. Two players toss ping pong balls attempting to direct the balls into one of the cups. Ping pong balls may be tossed directly or bounced on a substrate. If a ball touches a cup, it is considered 'sunk' whereupon the cup contents must be consumed by the opposing team. "Scaling" occurs when a ball is tossed with the intention of knocking over a cup. In the event of scaling, the team whose player threw the ball is penalized by one cup. If, during game play, one team retains four cups while the other team's cup count reaches two, the losing team is "skunked" and must consume all six of the cups. As described therein, the BP Rules variant requires use of alcoholic beverages.

In a separate line of games and game devices are apparatuses for playing miniaturized, indoor variants of the game of basketball. Such devices and game variants involve one or more basketball-style baskets and game play involving a miniature "basketball" such as a ping pong ball. Such references, however, do not contain teachings to combine the game of basketball (or miniaturizations thereof) with any known drinking games, whether beer pong or otherwise. For example, U.S. Pat. No. 3,724,855 to Chu discloses a basketball game including a stand bearing a backboard, a net and a catapult for shooting a ping pong-sized ball and is operated by hand. U.S. Pat. No. 4,973,056 to Nutting provides a simulated basketball game including a playing surface having baskets at its opposite ends and defining a plurality of interconnected ball-propelling paddles controlled by a user via a fluid pressure cylinder mechanism connected to a plurality of levers.

U.S. Pat. No. 5,150,898 to Hochberg et al. teaches a game apparatus including a projectile propeller mounted on the forward end portion of a housing and includes a target, such as a miniature basketball basket, mounted to translate forwardly and rearwardly with respect to the projectile propeller adjacent a rearward end portion of the housing and where the projectile propeller is operable to propel a game projectile, such as a ping pong ball, towards the target with a varying trajectory relative to the translational position of the target.

U.S. Pat. No. 4,210,328 to Meintzer et al. discloses a tabletop basketball game comprised of a flat, rectangular game board having standard basketball markings imprinted thereon. Four upstanding walls are positioned about the periphery of the game board in continuous relation to one another and with miniature basketball nets attached to two such walls opposite one another wherein contestants attempt to bounce a miniature-sized basketball, such as a ping pong ball, into one of the nets. U.S. Pat. No. 3,703,291 to Lutz claims a miniature basketball game apparatus including a flat base centrally slotted at one edge for receipt of a post supported on a thin foot for insertion beneath the slotted base and, in turn, supporting a backboard and net.

None of the drinking game references teach the inclusion of basketball elements, even though basketball variants are widely recognized as party novelty games, and none of the novelty basketball references teach the inclusion of beer pong elements, even though beer pong is rapidly growing in popularity as a party novelty game. What is needed then is an apparatus and game-play method that introduces elements of the game of basketball into the realm of alcoholic and non-alcoholic drinking games.

SUMMARY OF THE INVENTION

The present invention is designed to overcome the deficiencies of the prior art discussed above. It is an object of the present invention to provide apparatus for a drinking game in the nature of beer pong but which includes aspects of basketball.

It is another object of the present invention to provide apparatus for a drinking game played with ping pong balls that is portable.

It is an even further object of the present invention to provide apparatus for a drinking game that can be easily assembled and disassembled and which easily fits into a carrying case for portability.

In accordance with illustrative embodiments demonstrating features and advantages of the present invention, there is provided an apparatus for playing a drinking game that includes a base support member and a vertical pole extending upwardly from the base support member. A vertically extending backboard is secured to the pole adjacent the top thereof and a plurality of hoops are removably secured to the backboard. Plastic drinking cups are held in each of the hoops. The apparatus further includes a plurality of ping pong balls capable of being tossed into and maintained in the cups. The entire apparatus can be disassembled so that it is portable. That is, the hoops are removably secured to the backboard which is removably secured to the vertical pole. In addition, the vertical pole is comprised of several pole sections that fit together in a telescoping manner. The base includes a carrying handle and functions as a carrying case for holding and transporting the pole sections and the hoops with the backboard serving as a cover for the case.

Other objects, features and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form that is presently preferred; it being understood that the invention is not intended to be limited to the precise arrangements and instrumentalities shown.

DETAILED DESCRIPTION OF THE PREFERRED EMBODIMENT

Figure 1:
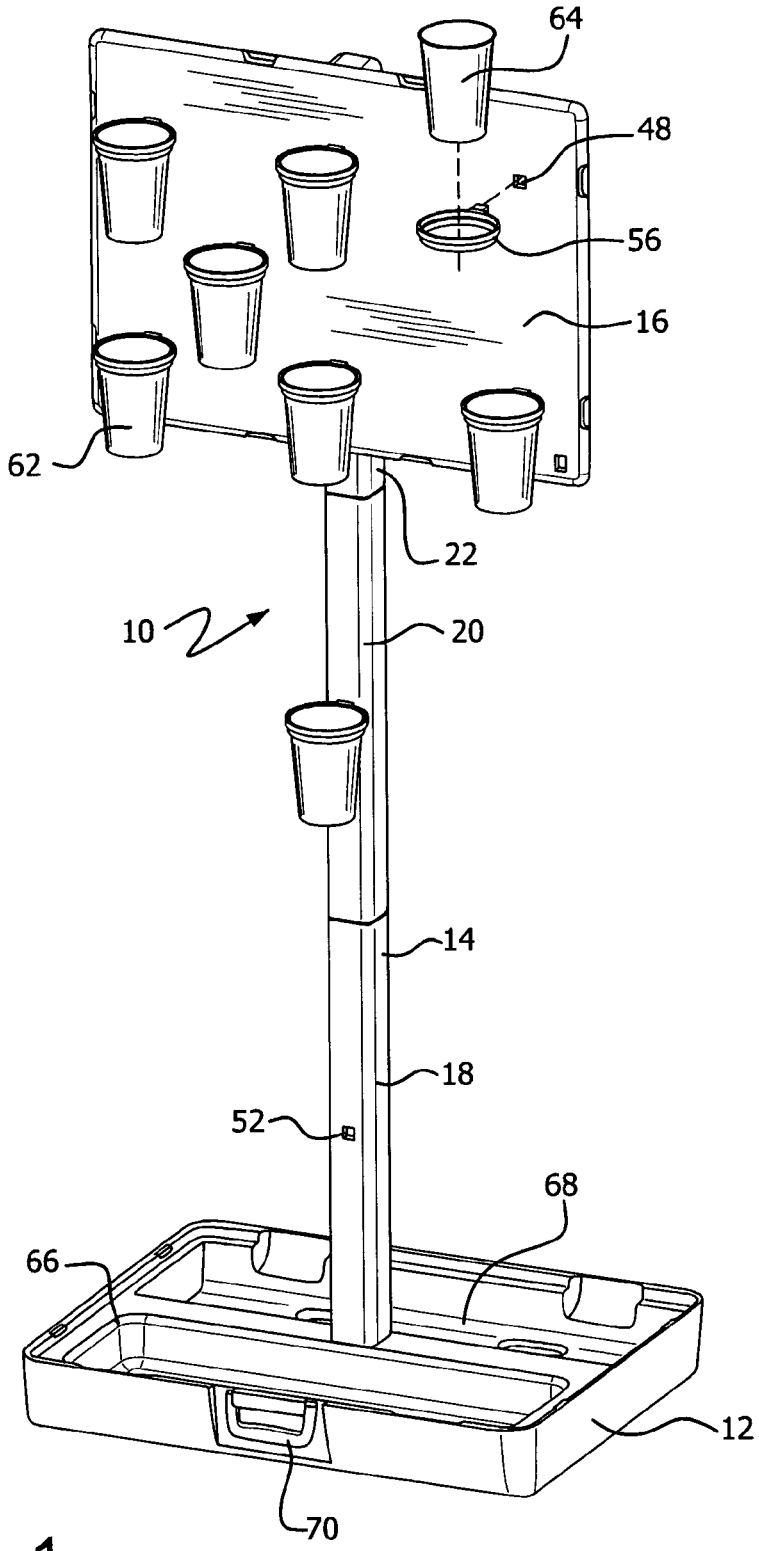
FIG. 1 is a front perspective view of the drinking game apparatus of the present invention.

Referring now to the drawings in detail wherein like reference numerals have been used throughout the various figures to designate like elements, there is shown in FIG. 1 an apparatus for playing a drinking game constructed in accordance with the principles of the present invention and designated generally as 10. The apparatus 10 includes a base support member 12, a vertical pole 14 extending upwardly from the base 12 and a vertically extending backboard 16 secured to the vertical pole 14 adjacent the top thereof.

The apparatus thus far described and as can be seen in the various figures looks similar to a basketball backboard mounted on a vertical pole. It is, however, somewhat smaller and significantly lighter. Although the pole 14 can be of essentially any height desired, it is preferably somewhere between five and seven feet in height. The backboard 16 may also be of essentially any size and shape desired. In the simplest form of the invention, the backboard 16 is substantially rectangular in shape having a height of approximately one and one-half feet and a width of approximately two feet. The base 12 is wide enough and heavy enough to support the pole 14 and the backboard 16 (along with cups filled with beer as described more fully hereinafter).

Figure 4:
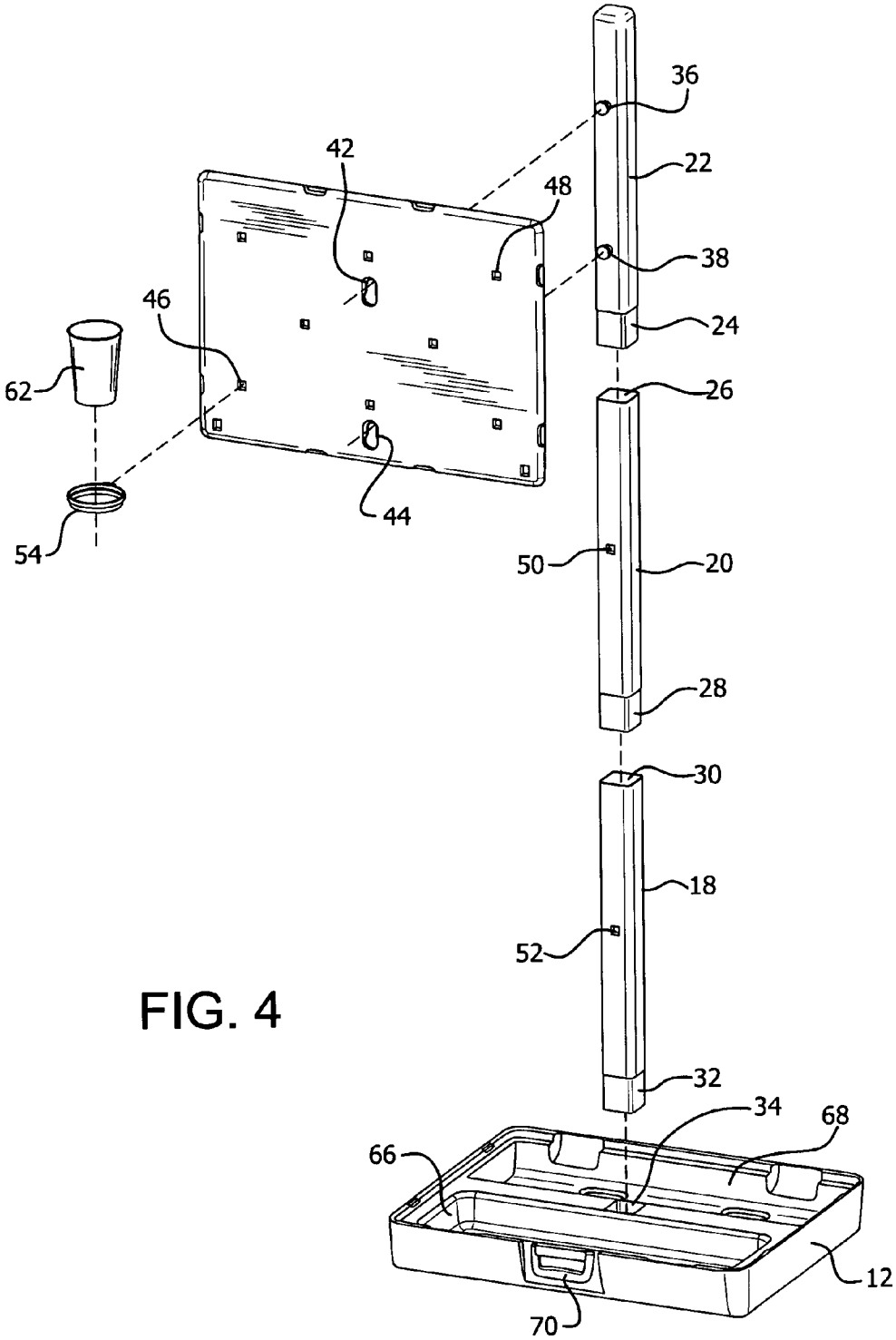
FIG. 4 is a front perspective exploded view showing how the various parts of the apparatus are assembled.
Figure 5:
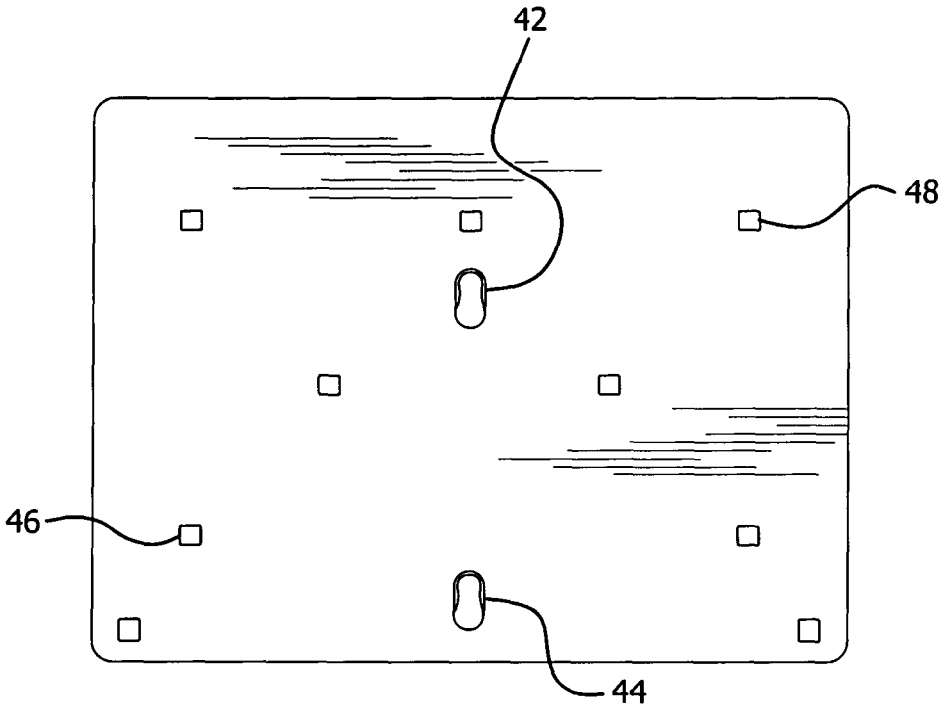
FIG. 5 is a front elevational view of the cover of the carrying case which also functions as the backboard.

As shown most clearly in FIG. 4, the pole 14 is preferably comprised of three or more pole sections 18, 20 and 22. The lowermost end 24 of the pole section 22 has a reduced outer dimension that telescopingly fits into the upper end 26 of the pole section 20. Similarly, the lower end 28 of the pole section 20 has a reduced dimension that fits into the upper end 30 of the lowermost pole section 18. Even further, the lowermost end 32 of the lower pole section 18 has a reduced dimension that fits into a socket 34 in the base 12.

Preferably, the various pole sections 18, 20 and 22 merely friction fit into each other and into the base 12. This allows the three pole sections to be easily assembled and disassembled whenever desired.

Figure 7:
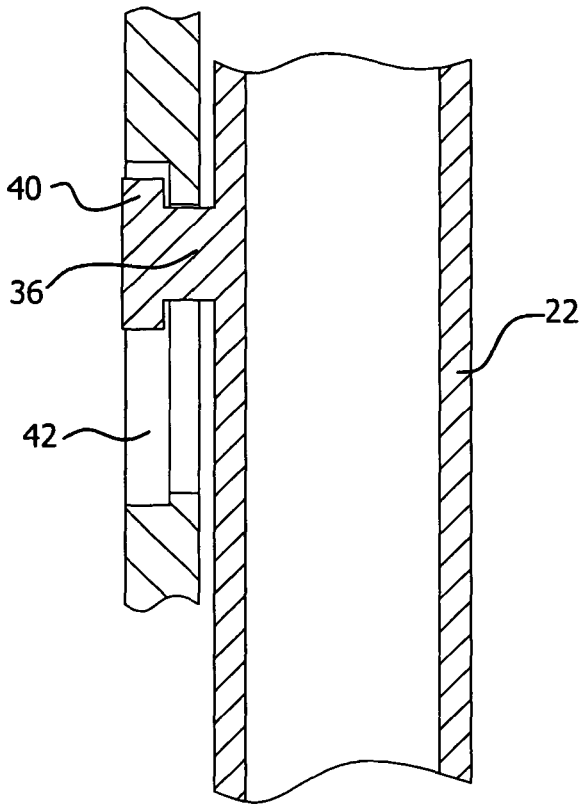
FIG. 7 is a cross-sectional view illustration how the backboard is attached to the support poles.

The upper pole section 22 includes forwardly extending pins 36 and 38 with enlarged heads such as shown at 40 in FIG. 7. The backboard 16 includes a pair of keyhole slots 42 and 44 that fit over the pins 36 and 38 and lock in place in a manner well known in the art. Again, this allows the backboard 16 to be easily attached to or removed from the pole 14 whenever desired. Alternatively, the backboard 16 could be mounted on a wall or other support in lie of using the pole 14. As should be readily apparent to those skilled in the art, more than or less than three pole sections can be utilized with the invention.

In addition to the slots 42 and 44, the backboard 16 also includes a plurality of rectangular apertures such as shown at 46 and 48. In the embodiment shown in the drawings, there are nine or ten such apertures. This is, however, by way of example only. The number of apertures in the backboard may be more or less, as desired. Furthermore, the pattern of the apertures may be arranged in any manner desired. Similar rectangular apertures 50 and 52 may be formed in the pole sections 18 and 20.

The apparatus 10 of the present invention also includes a plurality of hoops such as shown at 54 and 56. Each of the hoops such as hoop 54 includes a tab 58 extending outwardly therefrom. The tab includes a hook portion 60 at the end that extends upwardly from the tab. (See FIG. 6)

The hoops 54 and 56 are secured to the backboard 16 by inserting the tab 58 through one of the apertures and allowing the hook 60 to lie on the rear surface of the backboard 16. This is, of course, by way of example only. It is also possible to have the tabs 58 merely be friction fit into or snap into the apertures. In any event, the attachment should be constructed in such a way that the hoops can be easily attached to and removed from the backboard 16. As should be readily apparent, hoops can similarly be attached to and removed from the pole sections 18 and 20 through the use of the apertures 50 and 52.

Once the hoops are in position, each hoop is fitted with a disposable, plastic drinking cup such as shown at 62 and 64. Because the cups are somewhat conical in shape, they easily fit into the hoops but are held in place and do not fall therethrough.

Any number or variety of rules can be adopted for playing a game utilizing the drinking apparatus 10 of the invention. Preferably, two substantially identical apparatuses are used that are spaced apart and facing each other much like a basketball court with a basket at each end. All of the cups on the backboard 16 can be filled or partially filled with beer or other beverage and players from each team throw, bounce or shoot ping pong balls towards their opponent's cups. If a ball successful enters a cup, the member of the opposer's team must drink the contents of the cup. Much like beer pong, that cup can then be removed. The cup mounted on the pole 14 is preferably filled with water and is used to clean any ping pong balls that have beer or other beverage on them. Obviously, the foregoing is by way of example only as numerous variations in the rules can be adopted utilizing the apparatus 10.

It is also possible to provide the backboard 16 with a larger hoop at the bottom thereof that extends across the width of the same in order to capture ping pong balls that do not enter the cups. The hoop can be essentially semi circular in shape or be in the form of a three sided rectangular frame with its ends secured to the lower and outermost apertures in the backboard. A net can then be carried by the larger hoop to capture the ping pong balls.

When it is desired to transport the apparatus 10, the cups are removed and the hoops 54 and 56 are removed from the backboard 16. The backboard is then removed from the upper pole section 22 and the pole sections 18, 20 and 22 are disconnected from each other and from the base 12.

Figure 2:
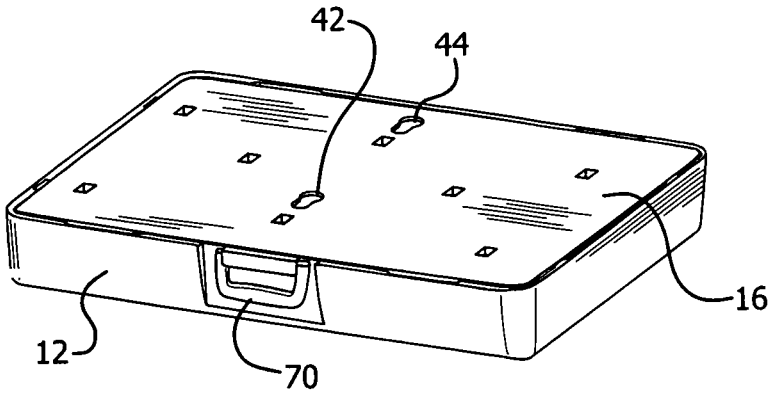
FIG. 2 is a front perspective view of a carrying case used for carrying the apparatus of the invention when it is disassembled.
Figure 3:
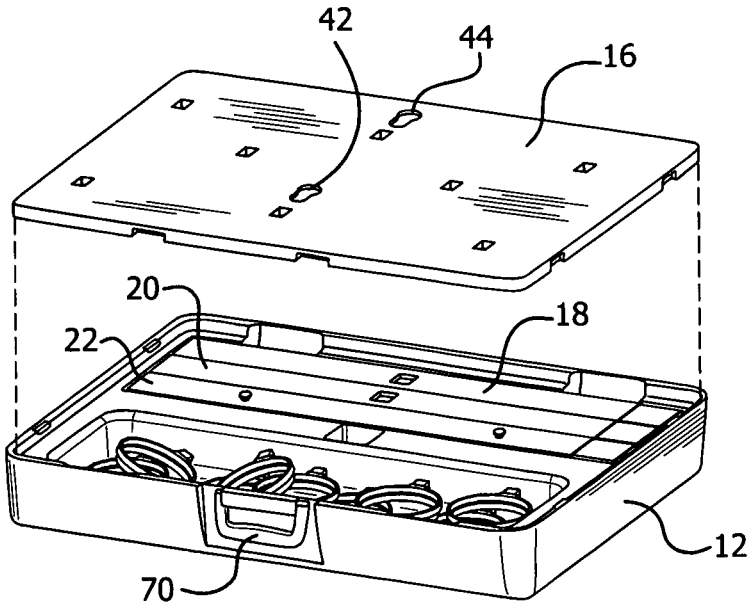
FIG. 3 is a view similar to FIG. 2 with the cover removed to expose the contents of the carrying case.
Figure 6:
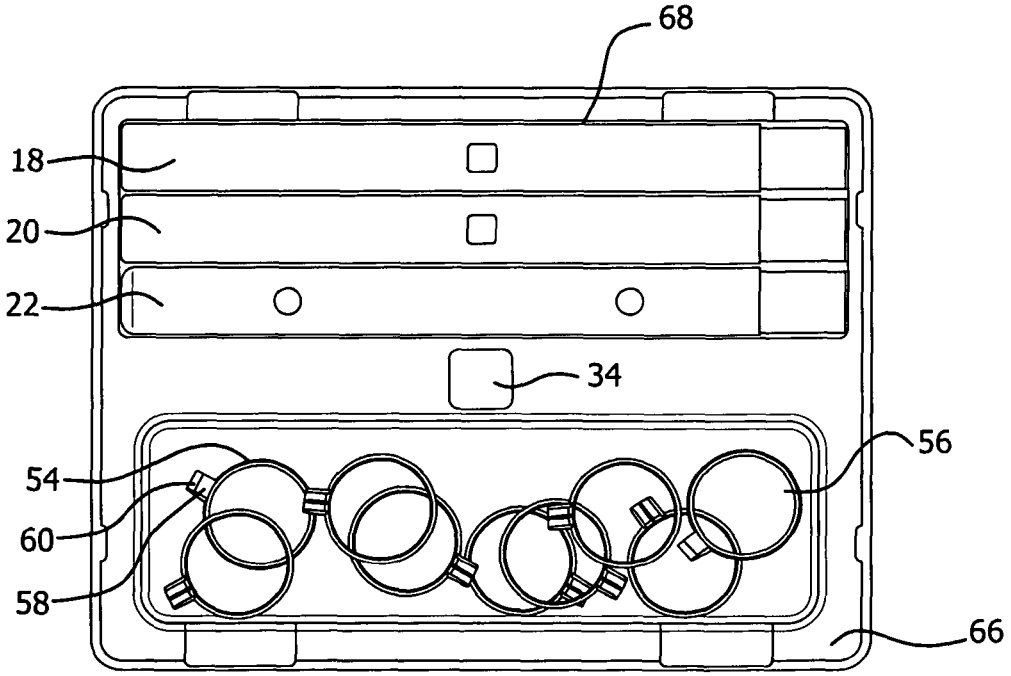
FIG. 6 is a top plan view showing the contents of the carrying case which includes the apparatus of the invention in its disassembled state.

As shown most clearly in FIG. 6, the base 12 has a forward compartment 66 which is large enough to hold all of the hoops. The base 12 also includes a rear compartment 68 into which can be inserted the pole sections 18, 20 and 22. The backboard 16 can then function as a cover that can snap or otherwise lock into place over the base 12 as shown in FIGS. 2 and 3. A handle 70 attached to the front of the base 12 can be used to carry the apparatus around. As should be readily apparent, two such bases such as shown in FIGS. 2 and 3 can be removably hinged together so that two entire apparatuses 10 can be carried to wherever it is desired to play the game.

All of the component parts are preferably made of plastic and can be manufactured utilizing any known molding techniques. Thus, the entire apparatus can be structurally strong while still being very light in weight for easy transport from place to place.

While the preferred embodiment of the invention, as illustrated in the drawings, shows the base 12 resting on a floor or on the ground, it is not beyond the scope of the invention to design the same to be use in a swimming pool or the like. In such a case, the base 12 can be constructed in such a way that it can float. Alternatively, an additional foam or inflatable float can be utilized onto which the base 12 can be placed.

The present invention may be embodied in other specific forms without departing from the spirit or essential attributes thereof and accordingly, reference should be made to the appended claims rather than to the foregoing specification as indicating the scope of the invention.

I claim:

1. An apparatus for playing a drinking game comprising:

a base support member;

a vertical pole extending upwardly from said base support member;

a vertically extending backboard secured to said pole adjacent the top thereof;

a plurality of hoops secured to said backboard, and a plurality of cups, said cups being held in said hoops.

2. The apparatus for playing a drinking game as claimed in claim 1 further including a plurality of balls capable of being tossed into and maintained in said plurality of cups.

3. The apparatus for playing a drinking game as claimed in claim 1 wherein said apparatus can be disassembled whereby it can be easily transported between different locations.

4. The apparatus for playing a drinking game as claimed in claim 3 wherein said hoops are removably secured to said backboard.

5. The apparatus for playing a drinking game as claimed in claim 3 wherein said vertical pole is comprised of several pole sections that fit together in a telescoping manner.

6. The apparatus for playing a drinking game as claimed in claim 3 wherein said base support member is capable of housing said vertical pole and said hoops to function as a carrying case therefor.

7. The apparatus for playing a drinking game as claimed in claim 6 wherein said backboard functions as a cover for said base support member when it is disassembled from said vertical pole.

8. The apparatus for playing a drinking game as claimed in claim 7 wherein said base support member includes a carrying handle.

* * * * *